United States Patent [19]

McKinnon et al.

[11] 4,312,396

[45] Jan. 26, 1982

[54] STRIP CLOSURE WITH IMPROVED SUPPORT SYSTEM

[76] Inventors: Duane M. McKinnon, 12766 Cypress Ave., Chino, Calif. 91710; David A. McKinnon, 1380 Fredricks La., Upland, Calif. 91786

[21] Appl. No.: 87,011

[22] Filed: Oct. 22, 1979

[51] Int. Cl.[3] ..... A47H 23/05

[52] U.S. Cl. ..... 160/332; 160/184

[58] Field of Search ..... 160/332, 330, 184, 196 R, 160/196 D; 248/225.1, 323

[56] References Cited

U.S. PATENT DOCUMENTS

| | | | |
|---|---|---|---|
| 1,206,421 | 11/1916 | Dickey et al. | 160/330 X |
| 2,074,928 | 3/1937 | Miller | 160/330 X |
| 3,683,572 | 8/1972 | Alten | 160/332 X |
| 3,967,129 | 6/1976 | Winkler | 160/332 X |
| 4,033,396 | 7/1977 | Thomasset | 160/332 |
| 4,095,642 | 6/1977 | McKinnon et al. | 160/332 |

FOREIGN PATENT DOCUMENTS

| | | | |
|---|---|---|---|
| 975286 | 9/1975 | Canada | 160/332 |
| 1508336 | 7/1968 | France | 160/184 |

*Primary Examiner*—Rodney H. Bonck

*Attorney, Agent, or Firm*—Boniard I. Brown

[57] ABSTRACT

A flexible multi-strip closure is supported in a vertically hanging position by means on horizontally oriented structural beads attached to each strip, which beads are retained in a horizontally oriented, inverted U-shape channel which includes an entrapment portion for supporting the beads against vertical forces and at least one lip to eliminate stress concentrations in the flexible strips when they are flexed. Releasable means are provided adjacent at least one end of the channel to restrict horizontal movement of the beads and to allow removal of the beads with their attached strips for cleaning and replacement.

9 Claims, 8 Drawing Figures

STRIP CLOSURE WITH IMPROVED SUPPORT SYSTEM

BACKGROUND OF THE INVENTION

Strip enclosures, doors and windows recently have become popular wherever there are high levels of traffic between two areas whose environmental conditions must be separated. For example, in walk-in freezer applications, strip doors enable sub-zero temperatures to be sustained inside the freezer without undesirable loss of the cold air, thereby saving energy and money. Strip closures also can be used to provide walkthrough doors, or passthrough windows when it is desired to keep a particular installation warmer than the outside ambient temperature. In some applications they are ideal for preventing movement of heavy industrial dust, dirt and contaminates from one area in a facility to another to reduce cleanup costs and improve the general appearance of the facility. Since the strips can be constructed from relatively economical material, their initial installation cost is relatively low. The strips also can be constructed from transparent material to eliminate the safety hazards inherent in blind opening doors and can be effective to reduce sound transmission by significantly cutting down noise transmitted from a source surrounded thereby without impairing access to the noise source. They can be used to control airborne particles by preventing the spread of dust, smoke and sparks by enclosing them in the areas where they originate and to prevent the entry of birds and flying insects.

Heretofore, strip closures have been installed by clamping the upper portion of each strip to a hangar assembly or by looping the strips over a rod installed adjacent the top of the opening to be covered. Both methods have disadvantages. Since the strips must overlap to form a barrier effectively, either the looping or the clamping installation system requires the removal of strip material adjacent the support which weakens each of the strips in the area where its strength needs to be greatest. In the looping system, all of the strips must be installed on the hanger rod before it is installed so that the installation, especially over a large opening, requires more than one person and once installed the entire assembly of strips must be removed to replace single strips or to successfully clean the ones in place. With the clamping system, bolts usually are provided to squeeze two structural members about the tops of the strips. The bolts pass through holes in some of the strips which tend to rip during use, and not being flexible, the structural members cause the strips to bend adjacent the bottom thereof causing stress concentrations which eventually cause the strips to break off.

BRIEF DESCRIPTION OF THE PRESENT INVENTION

In the present strip closures, an extruded, roll formed, stamped or molded elongate mounting member with an inverted U or keyhole shape is provided with suitable flanges to allow mounting adjacent the upper portion of the opening to be covered by means of a minimum of screws or bolts, none of which pass through the strips to be installed. The strips are then formed with a reinforced upper portion having a horizontal bead shaped to slide horizontally into the keyhole shape and to be restrained in vertical movement thereby. The lower part of the keyhole is smoothly flared outwardly. As the strips are flexed over the lower part, the flexure thereof tends to be distributed over a wide area so that no localized stress concentrations are created. The beads have less width than the strips so that adjacent strips can overlap to form the desired closure when installed in the mounting member. By properly bonding the beads to the strips and maintaining a predetermined bead length, the overlap of the strips is automatically fixed since the abutment of adjacent beads within the keyhole allows each strip to pass by the other only a predetermined amount. A removable restriction, such as a thumb screw, is provided adjacent at least one end of the mounting member to restrain the beads therewithin, yet at the same time provide means so that the beads can be moved laterally for removal, cleaning or replacement.

It is therefore an object of the present invention to provide a strip closure with a mounting system which has a minimum of parts, is relatively economical and easy to manufacture and has no heavy mounting hardware.

Another object of the present invention is to eliminate the need for punching or drilling holes in strips or notching the strips used to manufacture strip closures, thereby eliminating waste, speeding manufacture and allowing the strips to retain their full strength.

Another object is to provide strip closures which can be shipped flat to reduce shipping problems and eliminate fold induced wrinkles.

Another object is to provide a strip closures which can be installed by a single person.

Another object is to provide a strip closure whose strip can be installed and removed without resort to tools.

Another object is to provide a strip closure which requires no adjustment to straighten strips heretofore twisted by mounting bolts.

Another object is to eliminate areas of abrupt bending in a strip used for a strip closure adjacent its support.

These and other objects and advantages of the present invention will become apparent to those skilled in the art after considering the following detailed specification which discloses preferred embodiments thereof in conjunction with the accompanying drawings wherein:

DETAILED DESCRIPTION OF THE SHOWN EMBODIMENTS

Figures 1, 2, 3:
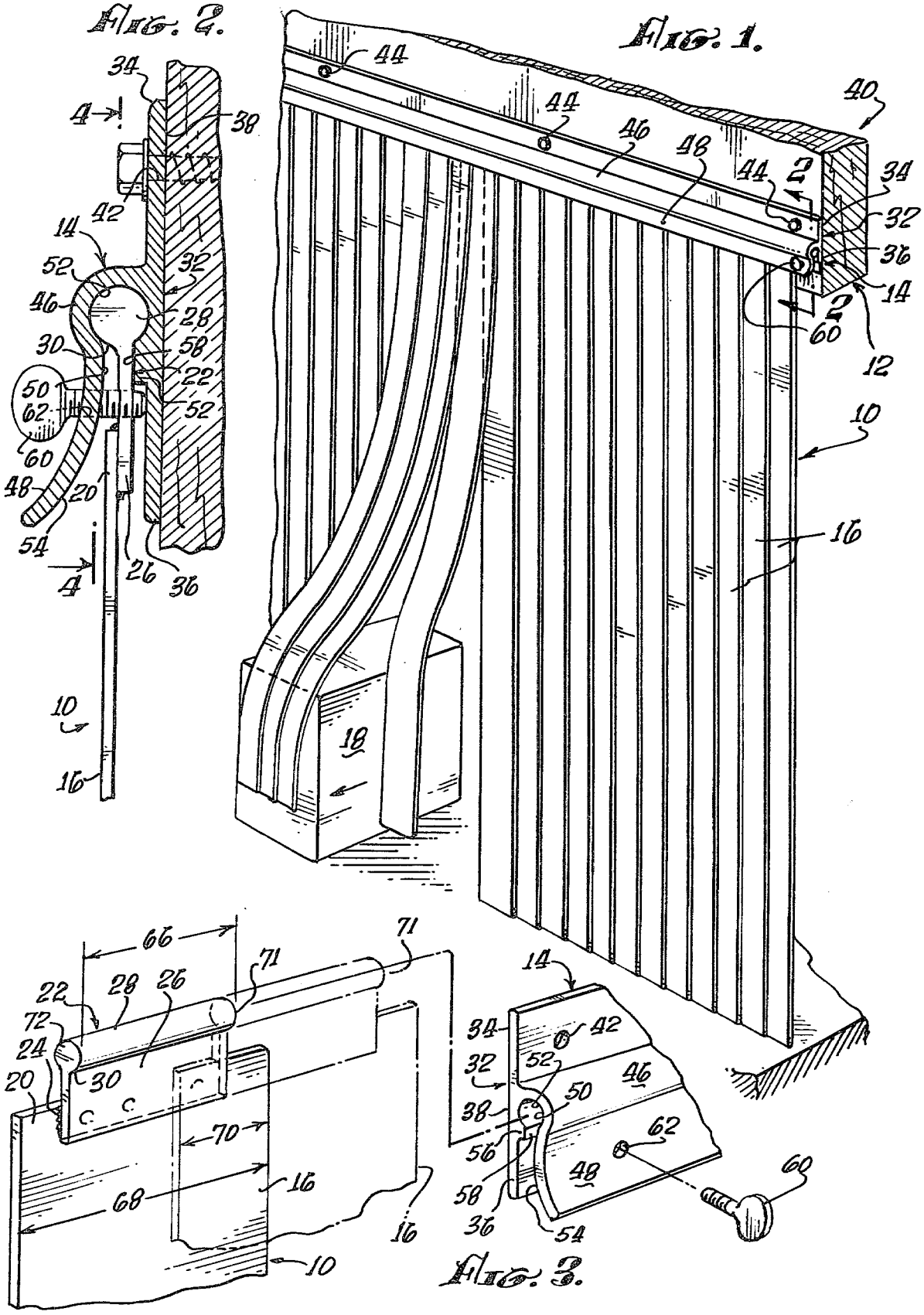
FIG. 1 is a perspective view of a flexible strip closure constructed according to the present invention which is installed closing a passageway in a structure.
FIG. 2 is an enlarged cross-sectional view taken at lines 2—2 of FIG. 1.
FIG. 3 is an exploded perspective view of a support member and reinforced beads attached to adjacent strips of FIGS. 1 and 2.

Referring to the drawings, more particularly by reference numbers, number 10 in FIG. 1 refers to a strip closure constructed according to the present invention. The closure 10 is shown installed in position to cover an opening 12 by means of a support system 14. Such strip closures 10 are constructed from a plurality of strips 16 which are installed to hang in an overlapped manner and thereby to form a closure. The strips 16 can be constructed from any type of flexible material, although plastic such as polyvinyl chloride is preferred. The strips 16 can be transparent, opaque, or in any desired color dependent upon the expected use. As shown in FIG. 1, the strips 16 deform and move out of the way when something such as a package 18 is moved therethrough. Once such a movement takes place and clears the strips 16, they fall by means of gravity back to their original overlapping positions as shown at the right side of FIG. 1 to restrict the passage therethrough of air, dust, small animals, intense sound, and when the strips 16 are opaque, light.

As shown in FIG. 2, each of the strips is provided at its upper end 20 with a reinforced attachment member 22 which is bonded thereto either by being fused, heat sealed or glued through the use of adhesive 24 suitable for the purpose. Each attachment member 22 includes a downwardly extending planar portion 26 which is attached to the strip 16 and an upper bead portion 28 shown shaped so that it has a horizontally extending semi-cylindrical surface 30 thereon. Although a cylindrical surface is preferred, other surface shapes such as square, hexagonal and the like, also can be employed.

The attachment member 22 is restrained within a horizontally oriented mounting member 32. The mounting member 32 includes mounting flanges 34 and 36 which form a planar surface 38 to abut the structure 40 adjacent the opening 12. Holes 42 are provided through the upper flange 34. Bolts or screws 44 are extended through the holes 42 to fasten the mounting member 32 to the structure 40.

Midway between the flanges 34 and 36, a third flange 46 extends outwardly away from the structure 40 and then downwardly to a smoothly flaring portion 48. The inner surface 50 of the flange 46 is curved to form a portion of a horizontally extending keyhole shape, sized so that when the bead portion 28 of the attachment member 22 is slid sidewardly therein, the attachment member 22 is restrained from vertical movement. The keyhole shape is formed as shown in FIG. 2 by a semi-cylindrical surface 52 which flows into a convex surface 54 at the flared portion 48 thereof. When the strips 16 are disturbed, as shown in FIG. 1, the surface 54 tends to distribute the bending loads in the strips 16 to prevent stress concentrations while the mating between the surface 52 and the bead portions 28 can enable some rotative motion to further reduce the stresses.

The mounting member 32 also includes a horizontally oriented ridge 56 at the opposite side of the surface 52 from the flared portion 48. The ridge 56 which is part of the flange 36 includes in addition to a portion of the surface 52, a vertically oriented surface 58 which abuts the planar portion 26 of the attachment member 22 to assure vertical positioning thereof when the strips 16 are not being disturbed. As shown, a thumb screw 60 is placed into a threaded hole 62 in the flared portion 48 so that it extends to the flange 36 across the keyhole, thereby blocking horizontal movement of the attachment members 22 out of the end 64 of the mounting member 32.

A typical configuration of the attachment members 22 is shown in FIG. 3 wherein adjacent strips 16 are overlapped an equal amount on both sides. As can be seen, the attachment members 22 are centrally located on the upper ends 20 of the strips 16 and have a bead width 66 which is less than the width 68 of the strips, an amount equal to the desired overlap 70 of the strips 16. When installed in the mounting member 32, the right side ends 71 of the attachment members 22 abut the left side ends 72 of the adjacent attachment members 22 so that the aforesaid spacing in overlap of the strips 16 is automatically assured. The attachment members 22 are maintained in side-to-side abutment by the installation of the thumb screw 60. When it is desired to remove one or more strips 16, this can be accomplished by merely removing the thumb screw 60 and sliding the attachment members 22 along the surface 52 until they are out of the side 64 of the mounting member 32 and free. This not only enables convenient replacement and cleaning of the strips 16 but enables installation of the mounting member 32 prior to the installation of the strips 16 and enables easy one-man installation. The overlapping of the strips 16 and the action of the thumb screw 60 can be seen more clearly with reference to FIG. 4.

Figures 4, 5, 6, 7, 8:
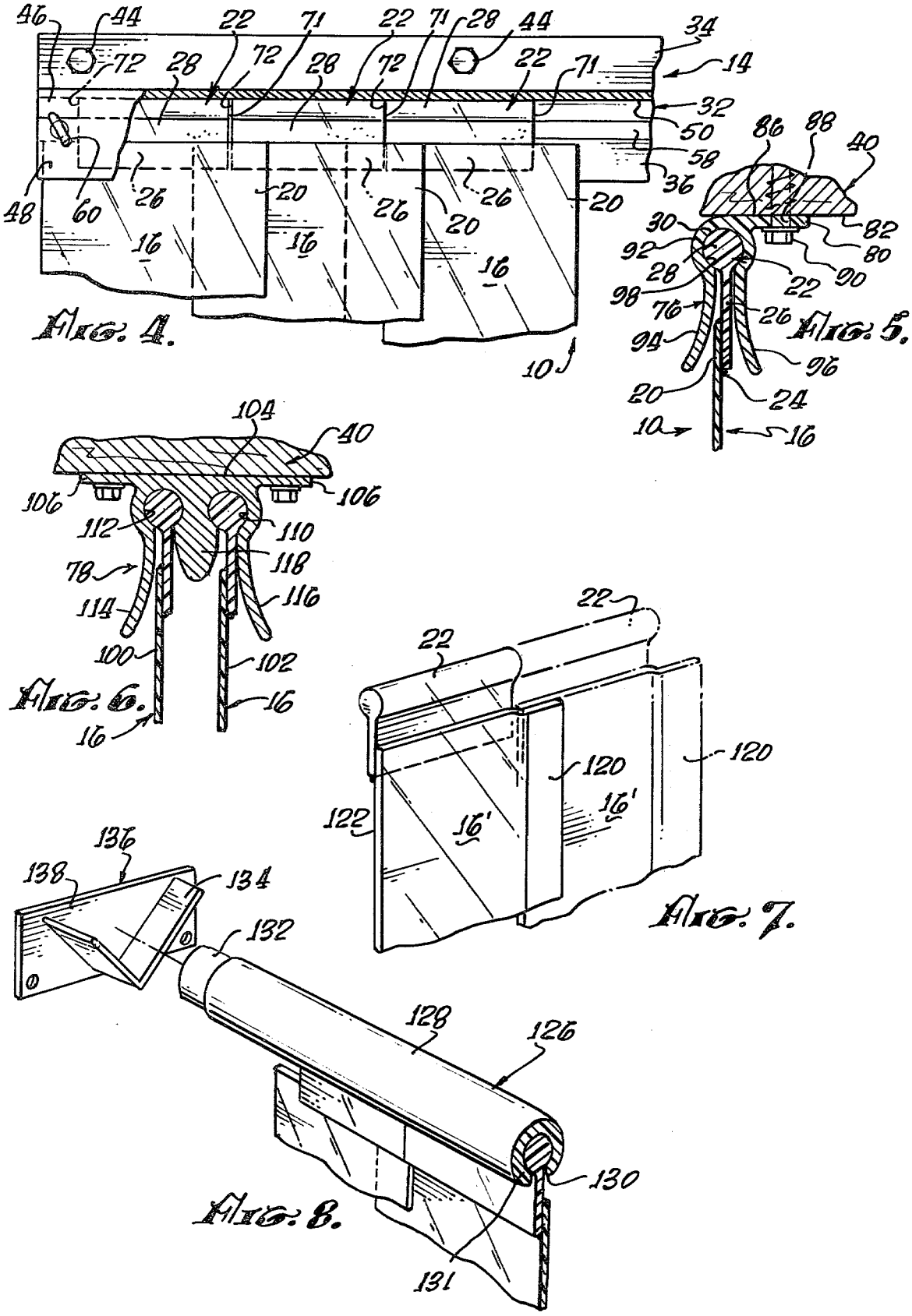
FIG. 4 is partial cross-sectional view taken at line 4—4 of FIG. 2.
FIG. 5 is a cross-sectional view of a modified form of the present invention allowing mounting to the upper underside of a window or doorway sill.
FIG. 6 is a cross-sectional view similar to FIG. 5 but showing a modification allowing installation of a double curtain closure formed by flexible strips.
FIG. 7 is a perspective view of a modified laterally offset support for the strips.
FIG. 8 is a perspective view of a further modified support for strip closures constructed according to the present invention.

Modified mounting members 76 and 78 are shown in FIGS. 5 and 6. The mounting member 76 of FIG. 5 includes a horizontal flange 80 for attachment to the underside 82 of the opening defining structure 40. The flange 80 like flange 34 includes a planar surface 86 for abuting the structure 40 and a plurality of holes 88 through which bolts or screws 90 can be used to retain the mounting member 76 in position. The mounting member 76 also includes a generally U-shaped portion 92 attached to the flange 80. The portion 92 includes a pair of downwardly extending flanges 94 and 96 used to distribute the loads when the strips 16 are deformed and a horizontally oriented semi-circular surface portion 98 for retaining the bead portions 28 of the attachment members 22. The other mounting member 78 is for supporting two parallel curtains 100 and 102 of strips 16 in parallel relationship. Like mounting member 76, it includes a planar surface 104 formed in part by laterally extending flanges 106 and 108 which normally are bolted to the structure 40. The mounting member 78 defines two horizontally oriented channels 110 and 112 for supporting and retaining the bead portions 28 of the attachment members 22 and includes a pair of downwardly extending stress relieving flanges 114 and 116 along with a curved downwardly extending ridge 118 centrally located therebetween. The flanges 114 and 116 and the ridge 118 are shaped to prevent stress concentrations in the attachment members 22 and the strips 16 retained thereby.

Strips 16' having a side joggle 120 are shown in FIG. 7 to form a different type of strip overlap. When such strips 16' are used, the attachment members 22 extend from a first side 122 of the strip 16' to adjacent the start 124 of the joggle 120 so that the strips 16' are automatically and correctly spaced when the attachment members 22 are placed in a suitable mounting member 32, 76 or 78.

In FIG. 8, the mounting member 126 is formed from a long hollow cylinder 128 having a cutout 130 through the sidewall 131 thereof for passage therethrough by the planar portions 26 of the attachment members 22. The cutout 130 is longitudinally extended along the member 126. The ends 132 of the member 126 are formed with a slightly reduced diameter so that they tend to remain in V-troughs 134 extending sidewardly from the bases 136 of attachment members 138. Each base 136 is adapted for attachment to structure 40 by bolts or screws so that the connected V-trough 134 faces upwardly and retains the member 126 by its ends 132.

Thus there has been shown and described novel strip closures which fulfill all the objects and advantages sought therefore. Many changes, alterations, modifications and other uses and applications of the subject closures will become apparent to those skilled in the art after considering this specification together with the accompanying drawings. All such changes, alterations and modifications which do not depart from the spirit and scope of the invention are deemed to be covered by the invention which is limited only by the claims which follow.

What is claimed is:

1. A strip closure with an improved mounting system for enclosing an opening in a structure, the closure including:

a plurality of flexible strips having thickness, width, and length, and an upper end;

a plurality of attachment members, each attachment member being attached to at least a portion of said upper end of said flexible strip, having a bead thereacross of a thickness greater than the thickness of said flexible strip, and including a planar portion which extends downwardly from said bead and is attached to said upper end of said attached strip, said bead being cylindrical in shape and oriented horizontally with respect to said attached strip which hangs therefrom; and mounting member means having means for horizontal attachment to the structure, an inverted channel portion with at least one open end, said inverted channel portion being shaped to retain said beads of said attachment members when subjected to vertical force, and means to close said inverted channel portion at least at said one open end, said attachment member having a width which is less than the width of said attached strip, each of said beads having opposite ends and abutment surfaces on said opposite ends thereof whereby when adjacent attachment members are placed with their abutment surfaces in abutment, said attached strips overlap.

2. The strip closure as defined in claim 1 wherein said attachment members are centrally located on the width of the strips.

3. The strip closure as defined in claim 1 wherein said strips have first and second side edges and a vertical joggle portion therebetween, each of said attachment members being located with one of their abutment surfaces in alignment with said first side edge of said attached strip and between said first side edge and said joggle portion.

4. The strip closure as defined in claim 1 wherein said mounting member means include:

an elongated hollow cylinder having opposite ends, a side wall, and a cutout in the wall thereof which extends from at least one end thereof; and a pair of wall connection members, each wall connection member having a sidewardly extending V trough connected thereto in position to support said ends of said elongated hollow cylinder.

5. A strip closure with an improved mounting system for enclosing an opening in a structure, the closure including:

a plurality of flexible strips having thickness, width, and length, and an upper end;

a plurality of attachment members, each attachment member being attached to at least a portion of said upper end of said flexible strip and having a bead thereacross of a thickness greater than the thickness of said flexible strip; and mounting member means having means for horizontal attachment to the structure, an inverted channel portion with at least one open end, said inverted channel portion being shaped to retain said beads of said attachment members when subjected to vertical force, means to close said inverted channel portion at least at said one open end, first and second flanges for mounting said mounting member means to the structure and defining a planar surface for contact with the structure, a third flange which is horizontally oriented and which extends sidewardly from said first and second flanges and then curves downwardly in general alignment therewith, said third flange having an inner surface, and a rib which extends horizontally along said mounting member means which defines a first surface, said first surface of said rib and said inner surface of said third flange forming a horizontally oriented surface having a curved cross-section which revolves more than 180° to partially surround and retain said beads and which extends horizontally from said open end.

6. The strip closure as defined in claim 5 wherein said third flange includes a convex surface which extends downwardly from said surface of curved cross-section and away from said planar surface for contact with said strips to prevent sharp bending of said strips thereagainst.

7. The strip closure as defined in claim 6 wherein said means to close said inverted channel portion at least at one open end includes:

a thumb screw having an abutment end; and an interior threaded surface positioned through said third flange and said convex surface so that when said thumb screw is threaded therethrough, said thumb screw extends across said inverted channel portion so said abutment end engages said second flange blocking sideward movement of said beads in said inverted channel portion toward said open end.

8. A strip closure with an improved mounting system for enclosing an opening in a structure, the closure including:

a plurality of flexible strips having thickness, width, and length, and an upper end;

a plurality of attachment members, each attachment member being attached to at least a portion of said upper end of said flexible strip and having a bead thereacross of a thickness greater than the thickness of said flexible strip; and mounting member means having means for horizontal attachment to the structure, an inverted channel portion with at least one open end, said inverted channel portion being shaped to retain said beads of said attachment members when subjected to vertical force, means to close said inverted channel portion at least at said one open end, at least a first horizontal flange for mounting said mounting member means to the structure and defining a planar surface for contact with the structure, and second and third horizontal flanges which extend downwardly from said first flange, said second and third flanges each having an inner surface a portion of which forms a surface having a curved cross-section which revolves more than 90°, said curved surfaces being connected to partially surround and retain said beads, said second and third horizontal flanges also including facing convex flange portions below said curved surfaces for contact with said strips to prevent sharp bending of said strips thereagainst.

9. A strip closure with an improved mounting system for enclosing an opening in a structure, the closure including:

a plurality of flexible strips having thickness, width, and length, and an upper end;

a plurality of attachment members, each attachment member being attached to at least a portion of said upper end of said flexible strip and having a bead thereacross of a thickness greater than the thickness of said flexible strip; and mounting member means having means for horizontal attachment to the structure, an inverted channel portion with at least one open end, said inverted channel portion being shaped to retain said beads of said attachment members when subjected to vertical force, means to close said inverted channel portion at least at said one open end, at least a first horizontal flange for mounting said mounting member means to the structure and defining a horizontal planar surface for contact with the structure, second and third horizontal flanges which extend downwardly from said first flange, said second and third flanges each having an inner surface, a portion of which forms a surface having a curved cross-section which revolves more than 90°, and a downwardly extending rib including surfaces each having a curved cross-section which revolves more than 90°, said curved surfaces of said rib and said curved surfaces of said second and third horizontal flanges being connected to form two channels to partially surround and retain said beads, said strips being aligned thereby to form two parallel curtains of strips.

* * * * *